US005611684A

United States Patent [19]

Spielman

[11] Patent Number: 5,611,684

[45] Date of Patent: Mar. 18, 1997

[54] FUEL-AIR MIXING UNIT

[75] Inventor: Lyle S. Spielman, Rockford, Ill.

[73] Assignee: Eclipse, Inc., Rockford, Ill.

[21] Appl. No.: 419,140

[22] Filed: Apr. 10, 1995

[51] Int. Cl.[6] ..... F23D 3/14

[52] U.S. Cl. ..... 431/353; 431/354; 60/737; 48/180.1; 239/431

[58] Field of Search ..... 431/353, 354; 60/737; 48/180.1; 239/431

[56] References Cited

U.S. PATENT DOCUMENTS

| | | | |
|---|---|---|---|
| 1,973,712 | 9/1934 | Justheim | 48/180.1 |
| 4,100,733 | 7/1978 | Striebel et al. | 60/737 |
| 4,484,885 | 11/1984 | Machii et al. | 431/354 |

*Primary Examiner*—Carroll B. Dority

*Attorney, Agent, or Firm*—Leydig, Voit & Mayer, Ltd.

[57] ABSTRACT

A mixing unit for mixing gaseous fuel and combustion air includes a fuel supply chamber adapted to receive a supply of fuel, an air supply chamber adapted to receive a supply of combustion air, and a manifold separating the air supply chamber and a transfer conduit which is adapted to deliver the fuel-air mixture to a burner. The manifold is formed with air ports establishing communication between the air supply chamber and the transfer conduit such that multiple streams of combustion air flow through the manifold and into the transfer conduit. The manifold is further formed with fuel supply cavities which communicate with the fuel supply chamber and which alternate with the air ports in the manifold. Multiple fuel ports connect each air port with the adjacent cavities such that multiple sets of oppositely directed jets of fuel mix with the combustion air as the combustion air flows through the manifold.

9 Claims, 3 Drawing Sheets

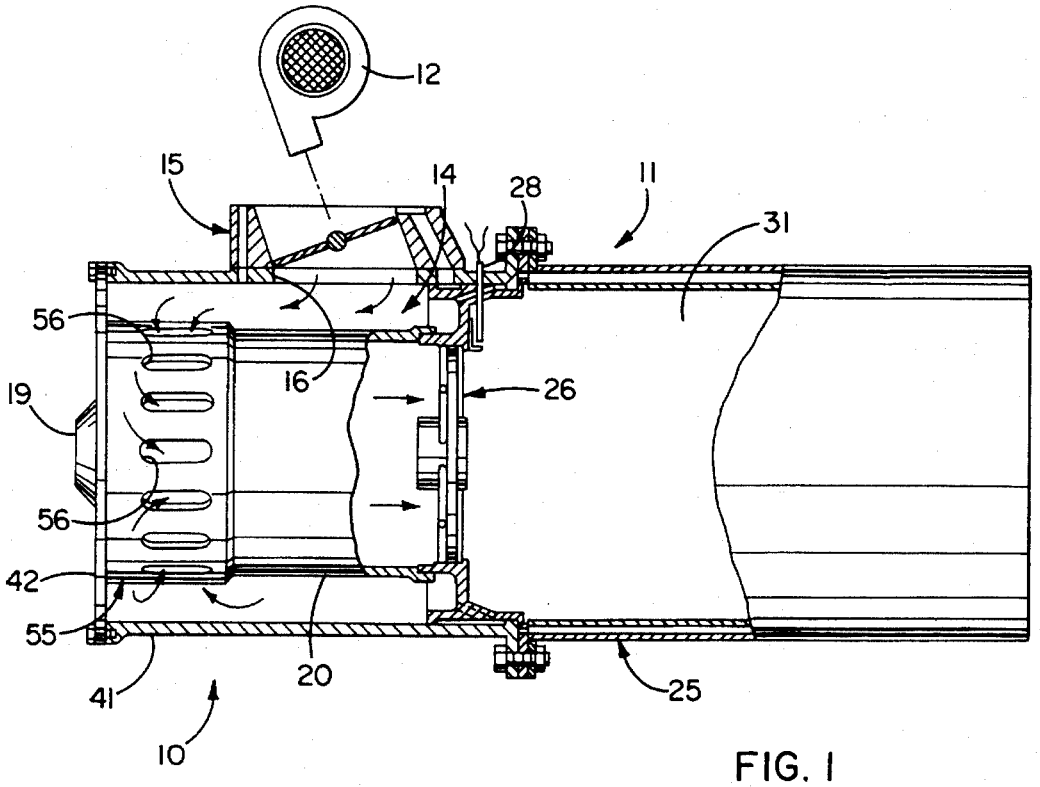
FIG. 1
FIG. 3
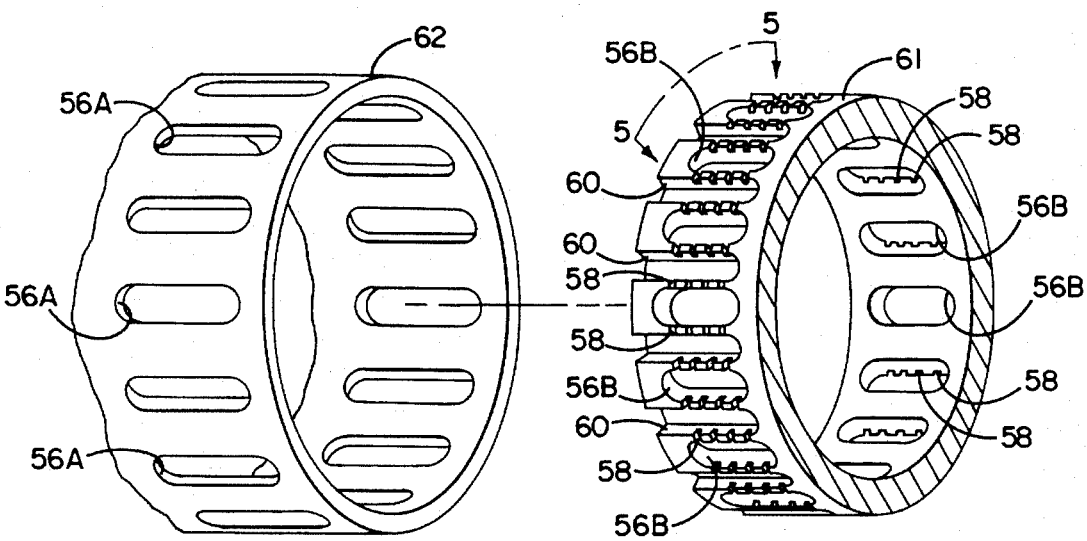

FUEL-AIR MIXING UNIT

BACKGROUND OF THE INVENTION

This invention relates generally to a mixing unit and more particularly to a mixing unit adapted to supply a mixture of gaseous fuel and combustion air to a premix burner of the type used in, for example, industrial heating systems. A mixing unit of this general type is adapted to receive a supply of gaseous fuel and a supply of combustion air by way of separate supply conduits. The fuel and the combustion air then mix together in the mixing unit whereupon the mixture is delivered to the premix burner by way of a transfer conduit.

Several mixing arrangements have been commonly used for mixing the fuel with the combustion air. For example, one prior mixing unit utilizes flowing combustion air to draw fuel into a relatively long mixing venturi whereupon the fuel and the combustion air mix together as they flow through the venturi. Another prior mixing unit causes the combustion air to swirl as it flows through a mixing tube and provides for radially outwardly directed jets of fuel to mix with the swirling combustion air. Generally, these and other prior mixing units tend to be relatively long in order to achieve a homogenous mixing of the fuel and the combustion air.

In addition, prior mixing units tend to cause a relatively large pressure drop in the combustion air as the combustion air flows through the mixing unit. A blower typically supplies the combustion air to the mixing unit and provides the air pressure which is necessary to move the combustion air through the heating system. The power which is required to operate the blower is related, in part, to the pressure loss in the combustion air as the combustion air flows from the blower to the burner. In prior mixing units such as the venturi-type mixing unit or the mixing unit which causes the combustion air to swirl in the mixing tube, the loss in air pressure due to the process of mixing the fuel and the combustion air can account for a substantial portion, if not the major portion, of the total pressure loss in the heating system. This total pressure loss can become substantial in industrial heating systems which require a relatively large volumetric flow rate of combustion air. In such heating systems, the additional capacity which is necessary to accommodate the pressure drop in the combustion air can result in the need for a larger blower. Moreover, the electric power associated with this pressure loss can amount to a substantial expense in the operation of the heating system.

SUMMARY OF THE INVENTION

The general aim of the present invention is to provide a new and improved mixing unit capable of mixing gaseous fuel and combustion air with less loss in air pressure when compared to prior mixing units of the same general type.

A detailed objective is to achieve the foregoing by providing for multiple streams of combustion air and by further providing for multiple jets of fuel mixing with each of the streams of combustion air.

A more detailed objective of the invention is to provide a manifold formed with elongated air ports through which the combustion air flows and further formed with fuel ports generally surrounding each air port so as to direct multiple jets of fuel into air ports.

The invention also resides in the provision of unique means for supplying combustion air to a burner so as to cool a combustion tube surrounding a flame in the burner.

These and other objects and advantages of the invention will become more apparent from the following detailed description when taken in conjunction with the accompanying drawings.

BRIEF DESCRIPTION OF THE DRAWINGS

FIG. 1 is a side view of a new and improved mixing unit incorporating the unique features of the present invention and including an integral burner, certain parts being broken away and shown in cross-section.

FIG. 3 is fragmentary exploded perspective view of certain parts shown in FIG. 2.

Figures 2, 4:
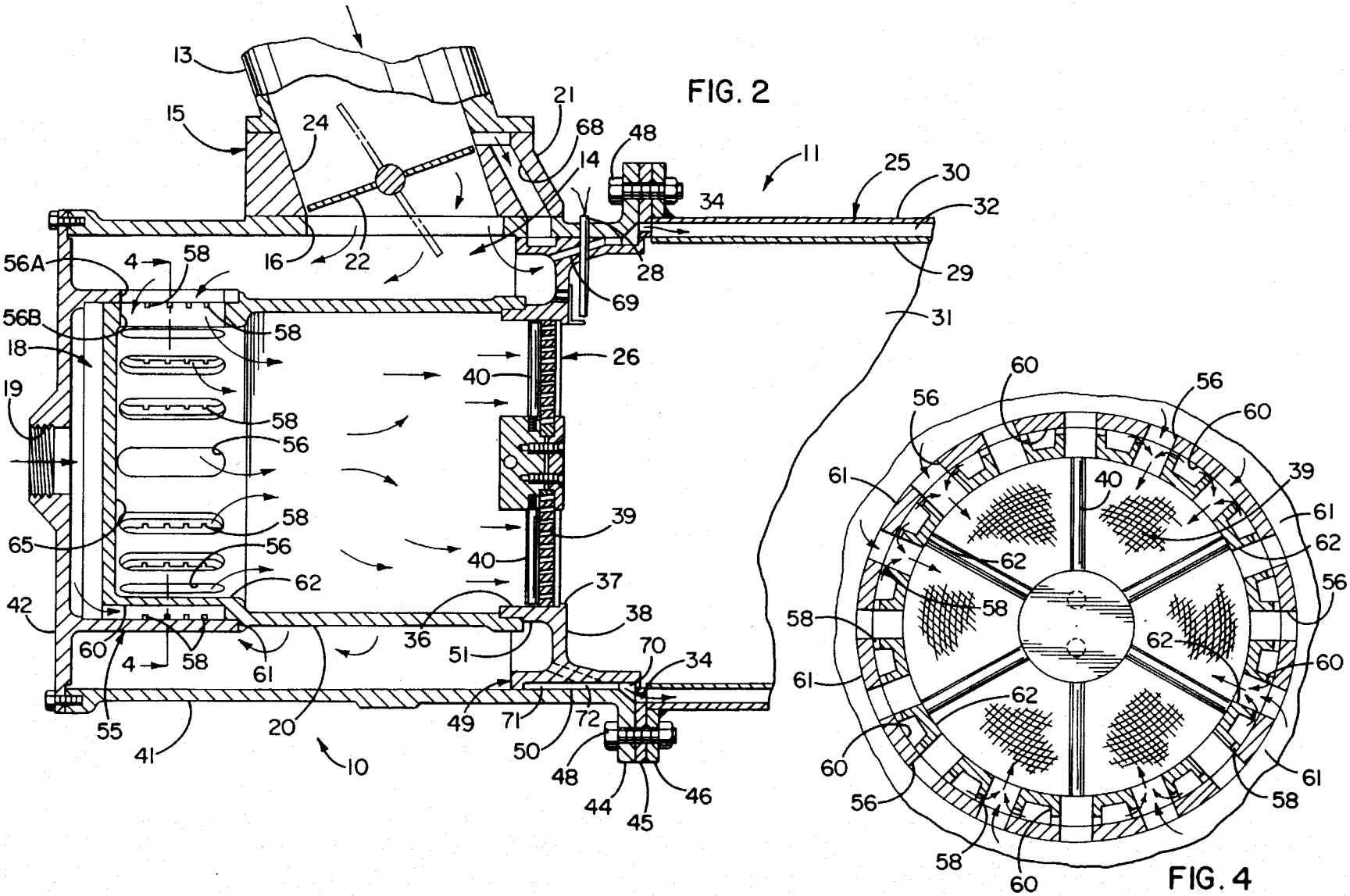
FIG. 2 is an enlarged cross-sectional view similar to FIG. 1.
FIG. 4 is a cross-sectional view taken substantially along the line 4—4 of FIG. 2.
Figure 5:
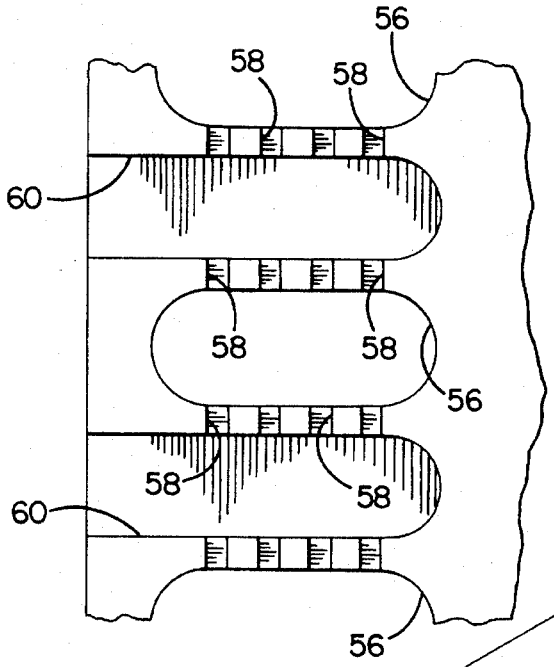
FIG. 5 is a fragmentary view taken substantially along the line 5—5 of FIG. 3.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENT

Figure 6:
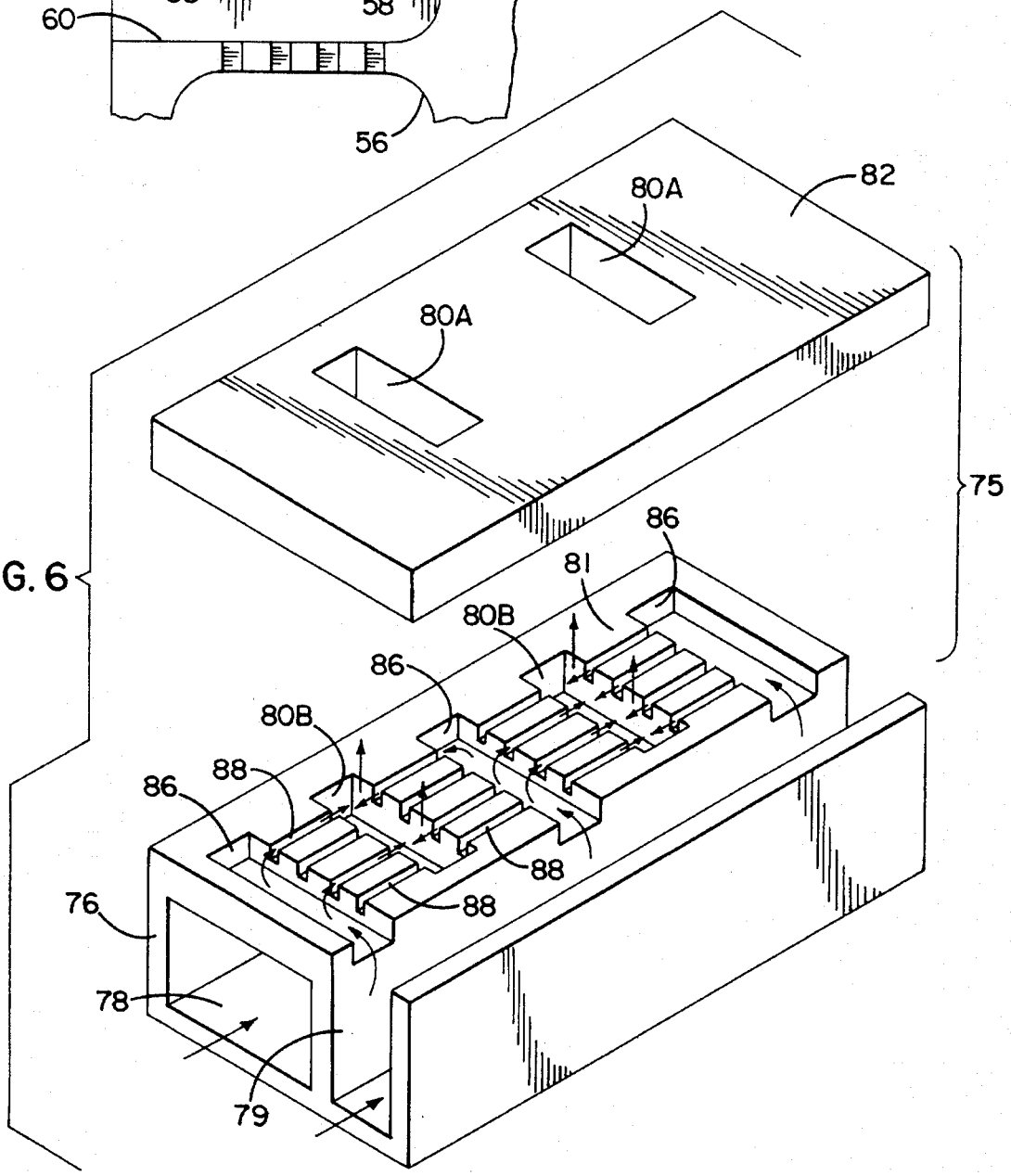
FIG. 6 is an exploded perspective view of an alternate embodiment.

For purposes of illustration, one embodiment of the present invention is shown in the drawings as incorporated in a mixing unit 10 (FIG. 1) adapted to supply a mixture of gaseous fuel and combustion air to a premix burner. While suitable for supplying a fuel-air mixture to either one or several stand-alone premix burners, the mixing unit 10 is especially adapted to supply a fuel-air mixture to an integrally packaged coaxial premix burner 11. One alternate embodiment of the invention illustrated in FIG. 6 is especially adapted to supply a fuel-air mixture to a line burner.

Briefly, a blower 12 delivers pressurized combustion air to the mixing unit 10 by way of an air duct 13 (FIG. 2). The combustion air then flows through a butterfly valve 15 and an air inlet port 16 whereupon the combustion air is received into a air supply chamber 14 of the mixing unit. The butterfly valve controls the flow rate of the combustion air entering the air supply chamber. The mixing unit also receives gaseous fuel in a fuel supply chamber 18 (FIG. 2) by way of a fuel inlet port 19. Control means (not shown) control the volumetric flow rate of the fuel delivered to the fuel supply chamber. As further discussed below, the fuel and the combustion air mix together in the mixing unit. The fuel-air mixture then flows through a transfer conduit 20 connecting the mixing unit with the burner 11 whereupon combustion of the fuel-air mixture occurs in a combustion chamber 31 in the burner.

The burner 11 includes a dual-wall combustion tube 25, a flame retention nozzle 26, and an electronic ignitor 28, each of which is individually secured to the mixing unit 10. The dual-wall combustion tube is defined by inner and outer tubular members 29 and 30, respectively. The interior of the inner tubular member defines the outer periphery of the cylindrical combustion chamber 31. The outer tubular member is coaxial with the inner tubular member to define an annular cooling chamber 32 between the tubular members. The cooling chamber is formed with inlet openings 34 for receiving a supply of cooling air and an open downstream end such that the cooling air may flow around and along the inner tubular member to cool the inner tubular member during normal operation of the burner. An inlet passage 36 connects the transfer conduit 20 with the combustion chamber such that the downstream end of the inlet passage defines an inlet opening 37 in a backwall 38 located at the upstream end of the combustion chamber. The electronic ignitor extends into the upstream end portion of the combustion chamber and is operable to produce a spark to initially ignite the fuel-air mixture and create a flame for sustained combustion of the mixture in the combustion chamber.

The flame retention nozzle 26 is located in the inlet passage 36 upstream of the combustion chamber 31. The flame retention nozzle includes a diffuser 39 and radially extending flame retention rods 40. The diffuser is formed of relatively small, tubular passageways which diffuse the mixture across the inlet opening 37 of the combustion chamber and smooth the flow of the mixture as it enters the combustion chamber. Moreover, the diffuser prevents flashback of the flame under conditions of relatively low flow rates by causing the velocity of the mixture to increase as the mixture flows through the passageways. The tubular passageways extend substantially parallel to but at a relatively small angle relative to the direction of flow of the mixture in the transfer conduit. This small angle imparts a slight rotation of the mixture as it enters the combustion chamber to reduce the length of the flame in the combustion chamber. The flame retention rods create zones of turbulence which extend into the upstream end of the combustion chamber to anchor the flame in the combustion chamber during conditions of relatively high flow rates. Reference is made to my co-pending U.S. application Ser. No. 08/449,716, filed Apr. 10, 1995, and entitled Low Emission Premix Burner (Attorney Docket No. 31939) for a detailed description of the illustrated burner 11.

The mixing unit 10 includes a generally cylindrical housing 41 and a backplate 42 which is secured to the upstream end of the housing and which closes off the upstream end of the mixing unit from the outside environment. The downstream end portion of the housing is formed with an integral flange 44 adapted to mate with flanges 45 and 46 welded to the upstream ends of the inner and outer tubular members 29 and 30, respectively. Fasteners 48 secure the flanges 44, 45, and 46 together such that the combustion tube 25 is secured to and extends forwardly or in the downstream direction from the downstream end of the housing. The mixing unit and integral burner 11 may then be mounted to, for example, an industrial heating system, by securing the flanges to a housing or support structure of the heating system.

Secured into the downstream end portion of the housing 41 is an end ring 49. The end ring is formed with an outer rim 50 extending longitudinally and adjacent the inner surface of the downstream end portion of the housing. The end ring extends radially inwardly from the central portion of the rim and then axially toward the backplate to define a cylindrical inner hub 51. The end ring serves to separate the burner 11 and the mixing unit 10 in that the downstream surface of the end ring defines the backwall 38 of the combustion chamber 31 while the interior of the inner hub defines the inlet passage 36 of the burner.

The butterfly valve 15 is secured to the housing 41 and includes a valve body 21 and a butterfly 22 mounted for rotation in a bore 24 formed in the valve body. The butterfly is adapted to be rotated between a full open position (shown in dashed lines in FIG. 2) and a substantially closed position. The butterfly valve does not fully close to insure a minimum flow of combustion air to the air supply chamber 14 during conditions of low fire in the burner 11. The bore 24 is formed at a small angle relative to the air inlet port 16 (e.g., 20 degrees) so as to reduce the overall height of the valve body. This arrangement enables relatively fine control of the volumetric flow of the air for rotation angles of the butterfly of approximately twice the angle of the bore relative to the air inlet port. The butterfly is preferably rectangular in shape, the bore having a rectangular cross-section, to enable the flow versus position characteristic of the butterfly to be modified by changing the length-to-width ratio of the bore and butterfly.

In accordance with one aspect of the invention, a manifold 55 is located between the air supply chamber 14 and the upstream end of the transfer conduit 20 and is formed with air ports 56 establishing communication between the air supply chamber and the transfer conduit. The air ports are relatively large openings extending through the manifold such that the combustion air flows directly through the manifold with relatively little loss in pressure for a given volumetric flow rate. The manifold is further formed with fuel ports 58 communicating with the fuel supply chamber 18 and generally surrounding each air port. The fuel ports extend through the sides of the air ports and are oriented in a generally crosswise direction with respect to each of the air ports so as to direct multiple jets of fuel inwardly toward the center of each air port. Accordingly, the fuel and the combustion air mix with relatively little loss in air pressure as the combustion air flows through the manifold.

More specifically, the air ports 56 are evenly spaced in the manifold 55 and are formed as elongated openings extending generally parallel to one another. The air ports are formed with two oppositely facing and substantially parallel sides and, for reasons which will become apparent, are preferably elongated in a direction extending away from the fuel supply chamber 18. Elongated fuel supply cavities 60 formed in the manifold alternate with and extend generally parallel to the air ports. The fuel supply cavities are formed with a closed end and with an open end which communicates with the fuel supply chamber. The fuel ports 58 extend parallel to one another and substantially perpendicular from each elongated side of each air port to the adjacent fuel supply cavity. As a result, each fuel supply cavity supplies fuel to the two air ports adjacent the elongated sides of the cavity, and each air port receives fuel from the two fuel supply cavities adjacent the elongated sides of the air port.

To facilitate manufacture and assembly of the mixing unit 10, the manifold 55 includes a manifold body 61 (FIG. 3) and a cover 62. The manifold body and the cover are positioned relative to one another in the mixing unit so that slots 56A in the cover align with similarly sized and spaced slots 56B in the manifold body to define the air ports 56. The fuel supply cavities 60 and the fuel ports 58 are formed in the manifold body as grooves having open portions which are closed off by the cover when the cover is secured relative to the manifold body.

In carrying out the invention, the manifold 55 is generally cylindrical and is located radially inwardly of and coaxial with the housing 41 near the upstream end of the mixing unit 10. The air ports 56 are angularly spaced in the manifold and are elongated in the longitudinal direction. The air ports extend radially through the manifold to provide for radially inwardly directed streams of combustion air into an outlet chamber defined radially inwardly of the manifold. The fuel supply cavities 60 are angularly spaced in the manifold between the air ports and extend longitudinally from the fuel supply chamber 18. The fuel ports 58 are longitudinally spaced in the manifold and extend circumferentially between the air ports and adjacent ones of the fuel supply cavities.

The manifold cover 62 is defined in a ring portion which is integrally formed with and which extends in the downstream direction from the backplate 42 to telescope over the manifold body 61. The cylindrical manifold body is sized such that the outer periphery of the manifold body is in substantially line-to-line contact with the inner periphery of the cover. The fuel inlet port 19 is formed in the backplate, extending through the backplate radially inwardly of the ring portion such that the supply of fuel is received in the interior of the ring portion. The upstream portion of the manifold body is formed with an end wall 65 spaced downstream from the backplate to close off the upstream interior of the ring portion so as to define the fuel supply chamber 18. The transfer conduit 20 extends between the downstream end of the manifold body and the inner hub 51 of the end ring 49 to close an annular space defining the air supply chamber 14. In the preferred embodiment., the transfer conduit is integrally formed with the manifold body and is formed with a minimum length equal to the diameter of the manifold. This arrangement allows the transfer conduit to be completely located within the housing, resulting in a relatively compact mixing unit especially adapted for use with the integral premix burner 11.

With the foregoing arrangement, combustion air enters the air supply chamber 14 by way of the air inlet port 16 and flows circumferentially around the transfer conduit 20 and toward the backplate 42 to fill the annular air supply chamber. Preferably, the air inlet port is located near the downstream end of the housing 41 to allow the incoming combustion air to completely surround the manifold 55 and to provide for evenly distributed air flow through the air ports in the manifold. Sets of oppositely directed and circumferentially flowing jets of fuel (FIG. 4) issuing from the fuel ports 58 mix with the combustion air as the combustion air flows through the air ports. The radially inwardly flowing streams of mixed fuel and combustion air then mix with one another as the streams enter and flow forwardly in the transfer conduit toward the burner 11. Advantageously, the relatively low pressure loss during the mixing of the fuel and the combustion air enables the mixing unit to provide a homogenous mixture over a relatively wide turndown range, i.e., a relatively wide range of volumetric flow rates of the fuel-air mixture.

In keeping with the invention, the butterfly valve 15 and the air duct 13 are preferably sized and configured to minimize the pressure loss between the blower 12 and the air supply chamber 14. To this end, the blower and the air duct are oriented at an angle which is aligned with the bore 24 of the butterfly valve. The inside of the air duct and the bore are of approximately the same size and shape. Moreover, the bore 24 is the same size as or smaller than the air inlet port 16. These measures generally minimize the pressure losses resulting from expansion, contraction, and turning of the combustion air as the combustion air flows from the blower to the air supply chamber.

Further in accordance with the invention, the mixing unit 10 is adapted to supply combustion air to the cooling chamber 32 for cooling the inner tubular member 29 of the combustion tube 25 during normal operation of the burner 11. Accordingly, the mixing unit eliminates the need for a separate supply line to provide cooling air to the cooling chamber.

More specifically, the mixing unit 10 is adapted to supply combustion air to the cooling chamber 32 by way of two parallel flow paths. One path provides a continuous flow of air to the cooling chamber while the second path supplies additional air to the cooling chamber as the pressure of the combustion air in the mixing unit increases. An auxiliary air inlet port 68 formed in the valve body 21 of the butterfly valve 15 provides the continuous flow of combustion air. The auxiliary air inlet port extends from upstream of the butterfly 22 to receive air independently of the position of the butterfly. Passages 69 extending from the air supply chamber 14 through the end ring 49 provide for additional combustion air as the butterfly valve opens.

In carrying out the invention, an annular chamber 70 is defined between the mixing unit 10 and the combustion tube 25 so as to enable communication between the mixing unit and the cooling chamber 32. The annular chamber is formed between the downstream end portion of the outer rim 50 and the downstream end portion of the housing 41, with a portion of the downstream wall of the annular chamber being defined by the flange 45 of the inner tubular member 29. Moreover, the annular chamber is located so that the inlet openings 34 to the cooling chamber open directly into the annular chamber.

A second annular chamber 71 is formed in the upstream portion of the outer rim 50 and is axially aligned with the auxiliary air inlet port 68 so that the auxiliary air inlet port opens directly into the second annular chamber 71. Longitudinally extending and angularly spaced slots 72 formed in the rim connect the chambers 70 and 71 to establish communication between the auxiliary air inlet port and the cooling chamber 32. The passages 69 extend in the downstream direction from the downstream side of the end ring 49 and slope outwardly until reaching the outer portion of the rim. The passages then extend longitudinally through the rim until reaching the annular chamber 70 to establish communication between air supply chamber 14 and the cooling chamber. Preferably, the passages 69 and the slots 72 are angularly spaced from one another in the end ring.

With this arrangement, the auxiliary air inlet port 68 receives the full air pressure from the blower 12 to provide a continuous flow of combustion air to the annular chamber 71. The annular chamber 71 distributes this continuous supply of combustion air to the slots 72 and into the annular chamber 70 between the mixing unit 10 and the combustion tube 25. This continuous supply of air then flows through inlet openings 34 and through the cooling chamber 32 to provide continuous cooling of the inner tubular member 29. As the butterfly valve 15 opens and the pressure in the air supply chamber 14 increases, additional air flows from the air supply chamber to the cooling chamber by way of the passages 69.

In an alternate embodiment shown in FIG. 6, the manifold 75 is adapted to provide for parallel streams of mixed fuel and combustion air. For purposes of illustration, the manifold is shown in a portion of a linear mixing unit adapted to supply a fuel-air mixture to a line burner (not shown) located above the mixing unit. The linear mixing unit includes a housing section 76 formed with horizontally and longitudinally extending air and fuel supply chambers 78 and 79, respectively. Typically, the linear mixing unit will consist of several of these housing sections connected together in series. To this end, the supply chambers 78, 79 are formed as passageways adapted to receive fuel and combustion air from an upstream housing section and to supply fuel and combustion air to a downstream housing section. The transfer conduit (not shown) extends vertically between the linear mixing unit and the burner. The transfer conduit may be included as an integral part of either the mixing unit or the burner, or it may be a separate conduit secured between the mixing unit and the burner. As is apparent by comparing FIG. 3 with the exposed portion of the manifold 75 shown in FIG. 6, the manifold 75 is, in essence, of the same basic construction as the manifold 55.

In the alternate embodiment illustrated in FIG. 6, the manifold 75 separates the air supply passageway 78 and the transfer conduit but is formed with vertically extending air ports to provide for parallel streams of combustion air. The manifold body 81 defines the upper horizontal wall portion of the air supply passageway. The manifold cover 82 is secured to the top of the manifold body so that slots 80A formed in the cover coact with slots 80B formed in the manifold body to define the air ports. In this embodiment, the cover extends beyond the body to close off the fuel supply passageway 79. The air ports, i.e., the slots 80A and 80B, are longitudinally spaced in the manifold and are elongated in the lateral direction to define laterally extending elongated sides. Elongated fuel supply cavities 86 communicate with and extend laterally from the fuel supply chamber. The cavities are longitudinally spaced in the manifold and alternate with the air ports. Laterally spaced fuel ports 88 extend between each elongated side of each slot 80B to the adjacent cavities, the cover closing the upper portion of the fuel ports. As a result, the fuel ports provide for sets of oppositely directed jets of fuel issuing from the elongated sides of the air ports so as to mix with the combustion air as the combustion air flows upwardly through the manifold.

From the foregoing, it will be apparent that the present invention brings to the art a new and improved mixing unit for mixing gaseous fuel and combustion air. By virtue of a uniquely configured manifold formed with multiple air ports and with multiple fuel ports generally surrounding each air port, the mixing unit is capable of mixing gaseous fuel and combustion air over a relatively wide turndown range and with less loss in air pressure than prior mixing units. Accordingly, the mixing unit reduces the power loss associated with the pressure drop in the combustion air as the combustion air flows through the mixing unit.

I claim:

1. A mixing unit for supplying a fuel-air mixture to a burner, said mixing unit comprising a housing having fuel passage means adapted to receive a supply of gaseous fuel, having air passage means adapted to receive a supply of combustion air, and having means forming a manifold for mixing the fuel and air to supply the fuel-air mixture for combustion, said manifold having a plurality of air ports of elongated shape formed therein and establishing communication from said air passage means so as to permit combustion air to flow from said air passage means through said air ports, said manifold further having a plurality of internal cavities alternating with said air ports and having a plurality of fuel ports connecting said air ports with adjacent ones of said cavities, said cavities communicating with said fuel passage means such that fuel flows from said fuel ports and initially mixes with the combustion air as the combustion air flows through said air ports.

2. A mixing unit as defined in claim 1 in which each air port is formed with two elongated and oppositely facing sides, said cavities being elongated and extending generally parallel to said elongated sides, said fuel ports being formed through each side of each air port and communicating with the adjacent cavity such that fuel flows into each air port from two generally opposing directions.

3. A mixing unit as defined in claim 1 in which said fuel passage means and said air passage means are elongated in a generally horizontal direction and are generally parallel to one another, said air ports and said cavities being horizontally aligned with one another and located above said air passage means, said air ports extending vertically through said manifold such that the combustion air flows upwardly through said air ports.

4. A mixing unit for supplying a fuel-air mixture to a burner, said mixing unit comprising fuel passage means adapted to receive a supply of gaseous fuel, means forming a generally annular air chamber adapted to receive a supply of combustion air, means forming a generally cylindrical outlet chamber coaxial with said air chamber, said outlet chamber having an exit end adapted to communicate with said burner for delivery of the fuel-air mixture to the burner, and means forming a manifold having a plurality of radially extending and angularly spaced air ports formed therein and establishing communication between said outlet chamber and said air chamber such that combustion air enters said outlet chamber in a plurality of radially directed streams, and means communicating with said fuel passage means for injecting fuel into each of said streams of combustion air from at least two generally opposing directions.

5. A mixing unit as defined in claim 4 in which each of said air ports having two longitudinally extending and oppositely facing sides, said manifold having a plurality of longitudinally extending and angularly spaced cavities communicating with said fuel passage means, said cavities alternating with said air ports, said fuel ports extending circumferentially between said sides of said air ports and said cavities such that the fuel flows generally circumferentially into said air streams from two opposing directions as the combustion air flows through said air ports.

6. A mixing unit as defined in claim 5 in combination with combustion air supply means and in combination with a burner having means forming a combustion chamber for combustion of the fuel-air mixture, said burner further having means forming a cooling chamber generally surrounding said combustion chamber, said combustion chamber and said cooling chamber having a common wall, said mixing unit further comprising first passage means establishing communication between said combustion air supply means and said cooling chamber such that combustion air is supplied to the cooling chamber for cooling said wall of said combustion chamber.

7. A mixing unit as defined in claim 6 in which said first passage means provides a continuous flow of combustion air to the cooling chamber, said mixing unit further comprising second passage means establishing communication between said air chamber and said cooling chamber, and valve means adapted to control the flow of combustion air to said air chamber such that the additional combustion air supplied to the cooling chamber by way of said second passage means increases as the pressure of the combustion air in said air chamber increases.

8. A mixing unit as defined in claim 5 in combination with a combustion air supply means, said mixing unit further comprising valve means adapted to control the flow of combustion air to said air chamber, said valve means including a housing with a bore establishing communication between said combustion air supply means and said air chamber, said bore being inclined relative to the longitudinal axis of said air chamber, said valve means further including a butterfly mounted for rotation in the bore so as to control the flow area in said bore, said butterfly having a full open position which is substantially parallel to the longitudinal axis of said bore.

9. A mixing unit for supplying a fuel-air mixture to a burner, said mixing unit comprising a housing having upstream and downstream end portions and having a generally cylindrical inner surface, a backplate substantially closing off said upstream end portion of said housing, a first ring portion projecting downstream from said backplate, a second ring portion projecting radially inwardly from said downstream end portion of said housing, a tubular member located radially inwardly of and coaxial with said inner surface of said housing, said tubular member having a substantially closed upstream end portion received in and engaging said first ring portion and having an exit end portion engaging said second ring portion so as to define an annular air chamber between said tubular member and said housing, said air chamber having substantially closed upstream and downstream ends and having an inlet opening adapted to receive a supply of combustion air, said upstream end portion of said tubular member being located downstream of said backplate so as to define a fuel chamber radially inwardly of said first ring portion, said fuel chamber having an inlet opening adapted to receive a supply of gaseous fuel, said first ring portion having a plurality of radially extending and angularly spaced slots, said upstream end portion of said tubular member having a plurality of radially extending and angularly spaced slots aligned with said slots in said first ring portion so as to establish communication between said air chamber and internally of said tubular member such that combustion air flows radially inwardly into said tubular member, said upstream end portion of said outlet tube further having a plurality of angularly spaced cavities alternating with said slots, said cavities communicating with and extending downstream from said fuel chamber, said upstream end portion of said tubular member further having a plurality of circumferentially extending fuel ports connecting said slots and adjacent ones of said cavities such that a plurality of jets of fuel flow into each of said slots so as to mix with the combustion air as the combustion air flows radially inwardly though said slots.

* * * * *